US010026563B2

(12) United States Patent
Di-Giacomo et al.

(10) Patent No.: US 10,026,563 B2
(45) **Date of Patent: *Jul. 17, 2018**

(54) INTEGRATED ELECTRICAL-SWITCHING MECHANICAL DEVICE HAVING A BLOCKED STATE

(71) Applicant: STMicroelectronics (Rousset) SAS, Rousset (FR)

(72) Inventors: Antonio Di-Giacomo, Rousset (FR); Christian Rivero, Rousset (FR); Pascal Fornara, Pourrieres (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 762 days.

This patent is subject to a terminal disclaimer.

(21) Appl. No.: 14/289,784

(22) Filed: May 29, 2014

(65) Prior Publication Data

US 2014/0266562 A1 Sep. 18, 2014

Related U.S. Application Data

(63) Continuation of application No. PCT/EP2012/072875, filed on Nov. 16, 2012.

(30) Foreign Application Priority Data

Dec. 9, 2011 (FR) ..... 11 61410

(51) Int. Cl.
*H01H 1/00* (2006.01)
*H01H 61/00* (2006.01)
*H01H 37/00* (2006.01)

(52) U.S. Cl.
CPC ..... *H01H 1/0036* (2013.01); *H01H 61/00* (2013.01); *H01H 2001/0068* (2013.01);
(Continued)

(58) Field of Classification Search
CPC ..... H01H 1/0036; H01H 37/46; H01H 37/48; H01H 37/72; H01H 61/00; H01H 71/18;
(Continued)

(56) References Cited

U.S. PATENT DOCUMENTS 3,743,977 A * 7/1973 Randall ..... H01H 37/52 337/102
6,498,347 B2 12/2002 Sauer et al.
(Continued)

FOREIGN PATENT DOCUMENTS

EP 2202767 A1 6/2010

OTHER PUBLICATIONS

Bouwstra, S. et al., "Thermal Base Drive for Micromechanical Resonators Employing Deep-Diffusion Bases," Sensors and Actuators, vol. 37-38, 1993, pp. 38-44.
(Continued)

*Primary Examiner* — Anatoly Vortman
*Assistant Examiner* — Jacob Crum
(74) *Attorney, Agent, or Firm* — Slater Matsil, LLP

(57) ABSTRACT

An integrated circuit, comprising an electrical-switching mechanical device in a housing having at least one first thermally deformable assembly including a beam held in at least two different locations by at least two arms secured to edges of the housing, the beam and the arms being metallic and situated within the same first metallization level and an electrically conductive body, wherein the said first thermally deformable assembly has at least one first configuration at a first temperature and a second configuration when at least one is at a second temperature different from the first temperature, wherein the beam is at a distance from the body in the first configuration and in contact with the said body and immobilized by the said body in the second configura-
(Continued)

tion and establishing or prohibiting an electrical link passing through the body and through the beam.

22 Claims, 11 Drawing Sheets

(52) U.S. Cl.
CPC . *H01H 2037/008* (2013.01); *H01H 2061/006* (2013.01); *H01H 2061/008* (2013.01)

(58) Field of Classification Search
CPC ... H01H 2001/0042; H01H 2001/0047; H01H 2001/0068; H01H 2001/0084; H01H 2037/008; H01H 2061/006; H01H 2061/008
USPC ..... 337/123, 128, 130, 139, 382, 392, 396; 200/181, 268
See application file for complete search history.

(56) References Cited

U.S. PATENT DOCUMENTS 7,339,454 B1 * 3/2008 Fleming ..... H01H 61/04 310/306
7,893,799 B1 * 2/2011 Slicker ..... H01H 1/0036 200/181
8,264,054 B2 9/2012 Cunningham et al.
2003/0051473 A1 * 3/2003 Quenzer ..... H01H 61/02 60/508
2005/0189204 A1 * 9/2005 Yeatman ..... H01H 1/0036 200/181
2006/0145793 A1 7/2006 Ning et al.
2009/0219128 A1 * 9/2009 Elliott ..... B81B 3/0078 337/379
2010/0158072 A1 6/2010 Fornara et al.
2010/0275904 A1 11/2010 Bathurst et al.
2013/0146873 A1 6/2013 Fornara et al.

OTHER PUBLICATIONS

International Search Report of the International Searching Authority received in Patent Cooperation Treaty Application No. PCT/EP2012/072875, dated Jul. 2, 2013, 6 pages.
Liao, K.M. et al., "A Novel Electro-Thermally Driven Bi-Directional Microactuator," 2002 International Symposium on Micromechatronics and Human Science, 2002, 8 pages.
Parameswaran, M. et al., "CMOS Electrothermal Microactuators," IEEE Proceedings of Micro Electro Mechanical Systems, Feb. 11-14, 1990, 4 pages.
Vayrette, R. et al., "Residual Stress Estimation in Damascene Copper Interconnects Using Embedded Sensors," Microelectronic Engineering, vol. 87, Issue 3, Mar. 2010, pp. 412-415.

* cited by examiner

CPS
PTL
BRS1
BRS2
ZXT
VX

MLB
Vdd
BRS1
GENB
BRS2
PTL
MVT4
ZXT
MVT3
VX

CMT
CPS
PTL
PTR
ENS1
Metal N
Metal N+1
Via

INTEGRATED ELECTRICAL-SWITCHING MECHANICAL DEVICE HAVING A BLOCKED STATE

This application is a continuation of PCT/EP2012/072875 filed Nov. 16, 2012 which claims the benefit of French Application No. 1161410, filed on Dec. 9, 2011, now French Patent No. 2984013, issued Jun. 14, 2013, titled "Integrated Electrical-Switching Mechanical Device having a Blocked State," both of which are incorporated herein by reference.

TECHNICAL FIELD

The invention relates to integrated circuits and more particularly electrical-switching mechanical devices such as interruptors or commutators that can be thermally or electrically activated and are capable of having a blocked state which can if necessary be unblocked.

The invention applies advantageously but not limiting to the detection of temperature thresholds within a product incorporating such an integrated circuit.

BACKGROUND

Currently, the switching devices produced within integrated circuits are usually switches of the Micro Electro Mechanical System (MEMS) type using elements made of polysilicon. However, the technology used to produce such switches is a dedicated technology that is difficult to integrate in a standard CMOS technological stream.

SUMMARY OF THE INVENTION

In one aspect, embodiments of the presented principles provide for an integrated circuit comprising a first metallization level separated from a second metallization level by an insulating region and disposed on a substrate, an electrically conductive body and an electrical-switching mechanical device in a housing. The electrical-switching mechanical device comprises at least one first thermally deformable assembly including a beam held in at least two different locations by at least two arms secured to edges of the housing, the beam and the arms being metallic and situated within the same first metallization level. The first thermally deformable assembly has at least one first configuration at a first temperature and a second configuration when at least one is at a second temperature different from the first temperature. The beam is at a distance from the body in the first configuration and in contact with the body and immobilized by the said body in the second configuration, establishing or prohibiting an electrical link passing through the said body and through the said beam. The said first thermally deformable assembly is configured to be activated and switch from one of the configurations to another.

In another aspect, embodiments of the presented principles provide for an integrated circuit comprising a first metallization level separated from a second metallization level by an insulating region and disposed on a substrate, a body formed from a conductive material, and a first electrical-switching mechanical device in a housing comprising at least one first thermally deformable assembly. The assembly comprises at least two arms secured to edges of the housing and a beam held in at least two different locations by the at least two arms. The first thermally deformable assembly has at least one first configuration at a first temperature and a second configuration when at least one is at a second temperature different from the first temperature.

The beam is at a distance from the body in the first configuration and in contact with the body and immobilized by the body in the second configuration. The beam may be further configured to establish an electrical link passing through the said body and through the said beam in one of the first configuration and the second configuration and configured to prohibit an electrical link passing through the said body and through the said beam in the other of the first configuration and the second configuration.

In another aspect, embodiments of the presented principles provide for a switching apparatus comprising a beam disposed in a housing, a first arm secured to the housing at a first end and secured to a first connection point on a first face the beam at a second end of the first arm. The first arm may be configured to thermally deform according to a change in temperature. The apparatus further comprises a second arm secured to the housing at a first end and secured to a second connection point on a second face the beam at a second end of the first arm, the second face of the beam opposite the first face of the beam, and the second connection point disposed between a free end of the beam and the first connection point. The second arm may be configured to thermally deform according to the change in temperature and, in conjunction with a deformation of the first arm, move the beam from a first position to a second position according the change in temperature. The apparatus may further comprise a body formed from an electrically conductive material, and the body may be configured to contact and immobilize the beam in the second position, and may be configured to be at a distance out of contact with the beam in the first position. The beam and the first arm and the second arm are metallic and disposed within a first metallization layer. The body is disposed in a second metallization layer different from the first metallization layer, with the first metallization layer and second metallization layers separated by an insulating layer and disposed over a substrate. The beam and the body permit an electrical link in the second position and prohibit an electrical link in the first position.

BRIEF DESCRIPTION OF THE DRAWINGS

Other advantages and features of the invention will appear on examination of the detailed description of embodiments which are in no way limiting and of the appended drawings in which.

DETAILED DESCRIPTION OF ILLUSTRATIVE EMBODIMENTS

Figure 1:
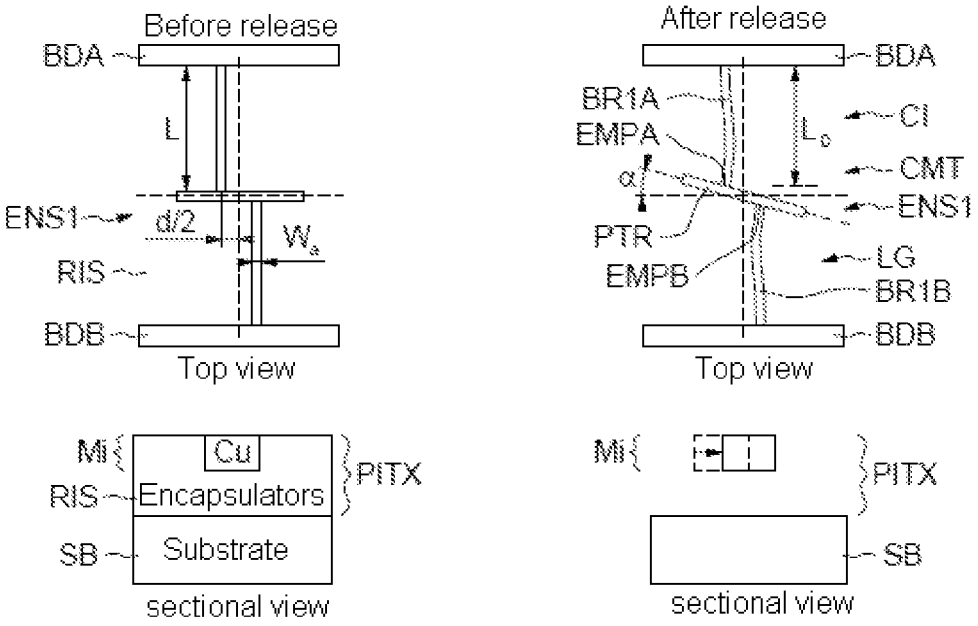
FIGS. 1 to 19, some of them being schematic, relate to various embodiments of a device according to the invention.

Before addressing the illustrated embodiments in detail, various embodiments and advantageous features are discussed generally in the following paragraphs.

According to one embodiment, a new electrical-switching mechanical device is proposed that can be integrated into all the CMOS technological streams by the optional addition of only a few extra operations (the addition of one masked level, for example), and this can be done without using the conventional MEMS technology, while being capable of detecting a temperature rise or drop, of adopting a blocked state when the temperature reaches a predefined threshold and of maintaining this same state if the temperature returns to its initial value.

According to one embodiment, an electrical-switching mechanical device is proposed that is capable of being "reset" from its blocked state.

According to one embodiment, a switching device is also proposed that has a limited impact in terms of surface area in the integrated circuit.

According to one embodiment it is therefore proposed to use at least one thermally deformable assembly, produced within a metallization level of the integrated circuit, and to use the physical behavior of the metal forming this thermally deformable assembly subjected to a temperature variation so as to establish or prohibit an electrical link passing through at least one portion of this thermally deformable assembly and through an electrically conductive body immobilizing or hooking a beam or pointer of this thermally deformable assembly.

According to one aspect, an integrated circuit is proposed that comprises, on top of a substrate, a portion comprising several metallization levels separated by an insulating region. Such a portion is commonly known to those skilled in the art by the acronym "BEOL" ("Back End Of Line").

According to a general feature of this aspect, the integrated circuit also comprises within the said portion an electrical-switching mechanical device comprising, in a housing, a first thermally deformable assembly including a beam held in at least two different locations by at least two arms secured to edges of the housing, the beam and the arms being metallic and situated within one and the same first metallization level.

The mechanical device also comprises an electrically conductive body, for example a cantilevered beam fitted with an appendage, for example of the "via" type; the said first assembly has at least one first configuration when it has a first temperature and one second configuration when at least one of the arms has a second temperature different from the first temperature, for example a higher temperature; the beam of the first assembly is at a distance from the said body in one of the configurations and in contact with the said body and immobilized by the said body, for example hooked by the appendage of the cantilevered beam, in the other configuration so as to be able to establish or prohibit an electrical link passing through the said body and through the said beam, the said first assembly being able to be activated, thermally or electrically, in order to switch from one of the configurations to another.

Such a mechanical switching device making it possible to establish or interrupt an electrical link, is therefore produced in the BEOL portion of the integrated circuits within one and the same metallization level or different metallization levels, and therefore has an essentially metallic structure that can be two-dimensional or three-dimensional. It is therefore integrated easily into a CMOS technological stream by largely using the conventional steps for producing the BEOL portion of the integrated circuit.

Moreover, the fact that, in one configuration, the beam of the first assembly is immobilized by the electrically conductive body, makes it possible in certain cases to confer a blocked state on the switching device, this blocked state then being naturally irreversible in the sense that the switch cannot return on its own to an earlier state unless specific means act on the switch in order to unblock it.

In other embodiments, the transition from the configuration in which the first assembly is immobilized by the body to a configuration in which the beam of the first assembly is at a distance from the body can be obtained by breaking a portion of the body, thus bringing about de facto a situation that is absolutely irreversible.

The first assembly, which is thermally deformable, can be thermally activated by a natural rise or drop in temperature, or can be electrically activated, the temperature rise being in the latter case obtained by Joule effect by the flow of a currant in the first assembly.

Various embodiments of the first assembly are possible, comprising a beam held in different locations by at least two arms or even two pairs of arms, at least some of the arms being able to comprise several parallel branches.

Similarly, the body immobilizing the beam of the first assembly in one of the configurations may comprise a cantilevered beam fitted with an appendage forming a hook, or optionally a second thermally deformable assembly with a structure similar to that of the said first assembly situated on a second metallization level different from the first metallization level within which the first assembly is situated, mounted symmetrically relative to the first assembly, the beams of the two assemblies being secured by an electrically conductive appendage, for example of the "via" type that can be broken.

According to one embodiment, the mechanical device comprises several first assemblies and several second assemblies forming, in one of their configurations, an electrically conductive chain in which all the breakable appendages are respectively secured to the corresponding ends of the beams of the first assemblies.

This makes it possible, for example when the appendages have different breaking strengths, to be able to detect the exceeding of a temperature threshold taken from several predefined thresholds.

If reference is made to FIG. 1, it can be seen that the mechanical switching device or switch CMT comprises here a first assembly ENS1 produced within one and the same metallization level Mi of the interconnection portion PITX of the integrated circuit CI, this interconnection portion also being commonly known to those skilled in the art by the acronym BEOL.

This portion PITX is situated above the substrate SB.

In the examples described here, the switch CMT is metallic and more particularly made of copper. Even so, the metal could be aluminum or tungsten without these two examples being limiting.

The switch CMT comprises here an assembly ENS1 in the form of an asymmetrical cross. This assembly ENS1 comprises a first arm BR1A and a second arm BR1B secured to a beam PTR, also called the "central pointer", in two locations EMPA and EMPB respectively situated on two opposite faces of the beam PTR. These two locations EMPA and EMPB are spaced at a distance d.

As will be seen in greater detail below, the assembly ENS1 is produced by using conventional techniques for producing metallic tracks of the interconnection portion PITX, used in CMOS technology in particular.

The left portion of FIG. 1 shows the switch CMT and more particularly the assembly ENS1 encapsulated in an insulating region RIS while the right portion of FIG. 1 shows the same assembly after etching of the insulating region so as to release the arms BR1A and BR1B and the beam PTR.

The assembly ENS1 thus released therefore extends inside a housing LG resulting from the withdrawal of the insulating region RIS, the two arms BR1A and BR1B being secured to the edges BDA and BDB of the housing.

It has been shown in the article by R. Vayrette et al. entitled "Residual stress estimation in damascene copper interconnects using embedded sensors", Microelectronics Engineering 87 (2010) 412-415, that after the deencapsulation of an assembly of this type, there is a relaxation of the stresses which causes a residual longitudinal deformation of the arms causing a deviation a of the pointer, here in the clockwise direction.

More precisely, assuming an arm of constant width Wa, the deviation a is expressed by the following formula:

$$a = \frac{d \cdot L \cdot L_0(L - L_0)}{d^2(2L - L_0) + \frac{4}{3} \cdot W_a^2 \cdot L_0}$$

in which L0 is the length of the arm after relaxation,

L0 is equal to $$\frac{L}{1 + \frac{\sigma}{E}}$$

where σ is the mean residual longitudinal stress and E is the Young's modulus of the material (approximately equal to 130 GPa for isotropic copper), σ is determined experimentally from measurements taken on test structures having various values of d and various values of Wa. Therefore, if 1/d equals 2 μm-1 and Wa equals 0.5 μm, σ is approximately 800 MPa.

As an indication, for arms with a length of 10 microns and a width of 0.2 microns, this gives a deviation of the pointer of the order of 0.2 microns for a spacing d of 2 microns. For a spacing of 1 micron, this gives a deviation a of the order of 0.3 microns. This corresponds to switches annealed at 400° C. with an insulating region RIS of 0.56 microns.

For a line width (arm width) of the order of 0.2 microns, this gives a mean residual longitudinal deformation of between 0.25% and 0.30% for a line width (arm width) of 0.5 microns, 0.20% for a line width of 1 micron, and slightly less than 0.20% for a line width of 2 microns.

Depending on the applications that are to be envisaged, and notably depending on the desired accuracy, for example in the case of detecting temperature, account may or may not be taken of this residual deviation a of the pointer PTR.

In this respect, and in general, knowing the coefficient of thermal expansion of the material forming the expansion arms, the geometry of the arms, notably their length and their width and their thickness, and the spacing d between the two fixing points, it is easy to simulate, notably by calculations of moments of force, the deviation of the pointer PTR when there is a temperature rise or a temperature drop.

Figure 2:
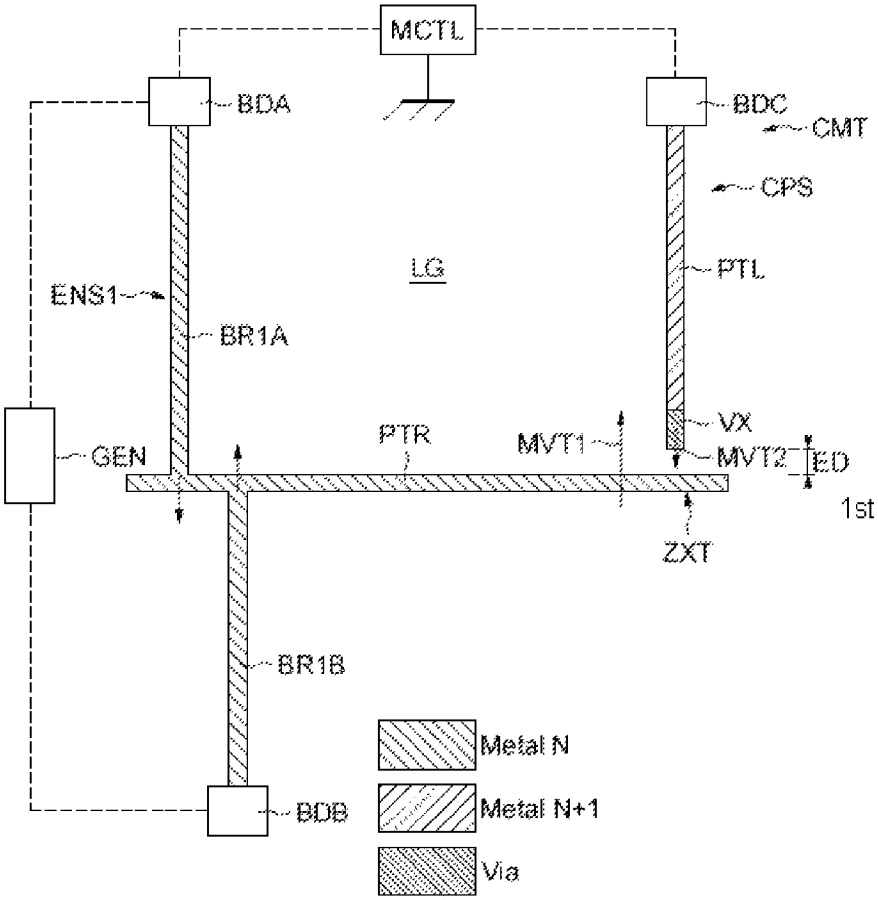
Figure 3:
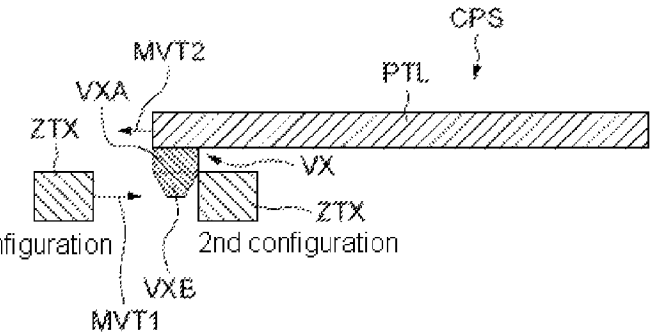

In the embodiment illustrated in FIG. 2 and FIG. 3, the arms BR1A and BR1B of the assembly ENS1 are fixed in the vicinity of a first end zone of the beam PTR, the other end zone ZXT of this beam PTR being free. The switch CMT moreover comprises an electrically conductive body CPS comprising here a cantilevered beam PTL secured to a portion BDC of an edge of the housing LG, and a metallic appendage VX situated at the free end of the beam PTL.

As can be seen more particularly in FIG. 3, the beam PTR (and the arms BR1A and BR1B of the assembly ENS1) is produced within a first metallization level, namely here the metallization level N while the cantilevered beam PTL of the body CTS is produced within another metallization level different from the first metallization level, in this instance the metallization level N+1.

Moreover, the appendage VX of the body CPS is produced within the level of vias, said level being situated between the metallization levels N and N+1. As will be seen in greater detail below, the appendage VX is produced in a manner similar to that used for the production of the vias in the BEOL portion of the integrated circuit. This being so, the appendage VX comprises a portion VXA extending between the two metallization levels N and N+1, extended by an end portion VXB extending partly into the first metallization level N. This end portion VXB widens out in the direction of the cantilevered beam PTL.

In FIG. 2, the assembly ENS1 is in a first configuration, for example when it is at ambient temperature. When there is a temperature rise of the integrated circuit, and consequently of the assembly ENS1, the arms BR1A and BR1B of the assembly expand and because of this the end ZXT of the beam PTR sustains a movement MVT1 taking the form here of a bending. Moreover, the cantilevered beam PTL of the body CPS expands and its free end, supporting the appendage VX, moves in a movement MVT2.

Because of this, and because the amplitude of these movements can be easily calculated as indicated above as a function notably of the geometry of the arms and of the coefficients of expansion of the materials, the spacing ED between the end ZXT of the beam PTR and the via VX, in the first configuration, is determined so that above a certain temperature, the assembly ENS1 adopts a second configuration in which, as illustrated in FIG. 3, the end zone ZTX of the beam PTR comes to the other side of the via VX while thus being immobilized and hooked by the via VX of the body CPS.

The movement of the end zone ZTX of the beam PTR from one side to the other of the via VX is made possible notably by the beveled shape of the end portion VXB of the via VX and also by the fact that the beam PTL that is cantilever-mounted, will bend when the end zone ZTX comes into contact with the beveled portion VXB of the via VX and by this lifting allow the movement of the zone ZTX to the other side of the via.

Once the zone ZTX has travelled to the other side of the via (second configuration), the via VX can descend again and hook the zone ZTX while being in contact with the latter.

And, in this second configuration, the beam PTR of the assembly ENS1 cannot naturally return to its first configuration even if the temperature returns to the initial temperature since the beam PTR is blocked by the via VX.

In the second configuration it therefore becomes possible to establish an electrical link passing through the body CPS and through the beam PTR.

Control means MCTL, placed for example in another portion of the integrated circuit, may therefore test the establishment or non-establishment of this electrical link.

In this respect, it is possible to use any conventional, known means. The means MCTL may for example comprise a generator capable of generating a power supply voltage on the edge BDA of the housing LG and verify, for example with the aid of logic circuits, that the current thus generated is indeed present at the edge BDC of the housing, the edges BDA and BDC being electrically insulated.

As a variant, the test for establishment of the electrical link may be carried out in a laboratory, for example during a customer return of the integrated circuit, by applying a voltage to the edge BDA and by verifying the appearance of a current on the edge BDC.

An application that is particularly worthwhile, but not limiting, of the invention lies in a detection of the breakage of a cold chain for a particular product, when the packaging of the said product incorporates for example an integrated circuit containing the switch CMT.

Naturally the switch can also detect a temperature drop. In this case the assembly ENS1 deforms by contraction of the arms causing a bending of the beam in the other direction and it is sufficient to position the beam PTL on the other side of the beam PTR while naturally also taking account of the contraction of the beam PTL.

As a variant, the assembly ENS1 that is thermally deformable can be activated electrically. Specifically, means GEN that are conventional and known per se are then provided, being capable of causing an electrical current to flow in at least one of the arms of the assembly ENS1, in this instance in the two arms ENS1 between the two edges BDA and BDB of the housing.

Because of this, the Joule effect produces a temperature rise of the two arms which causes the deviation of the beam PTR.

Once the beam PTR is in its second configuration, hooked by the via VX, the current also flows in the beam PTL, the housing edge BDC then being connected for example to earth.

This variant, for example, is used to detect too strong a current flowing in a portion of the integrated circuit connected to the assembly ENS1. Specifically, when the current exceeds a certain intensity thus causing, by the temperature rise of the arms BR1A and BR1B the hooking of the beam PTR in contact with the beam PTL, it becomes possible to subsequently detect this over-current of the integrated circuit with the aid of the means MCTL, for example when the integrated circuit is returned from the customer.

In such an application, the means GEN may comprise a portion of the integrated circuit within which it is desired to detect a possible over-current.

Whereas in the embodiment illustrated in FIGS. 2 and 3 the switch CMT had a naturally irreversible state, as explained above, it is possible, as illustrated in FIGS. 4, 5 and 6, to have the switch also comprise means MLB configured to release a beam immobilized by the body CPS.

Figures 4, 5, 6:
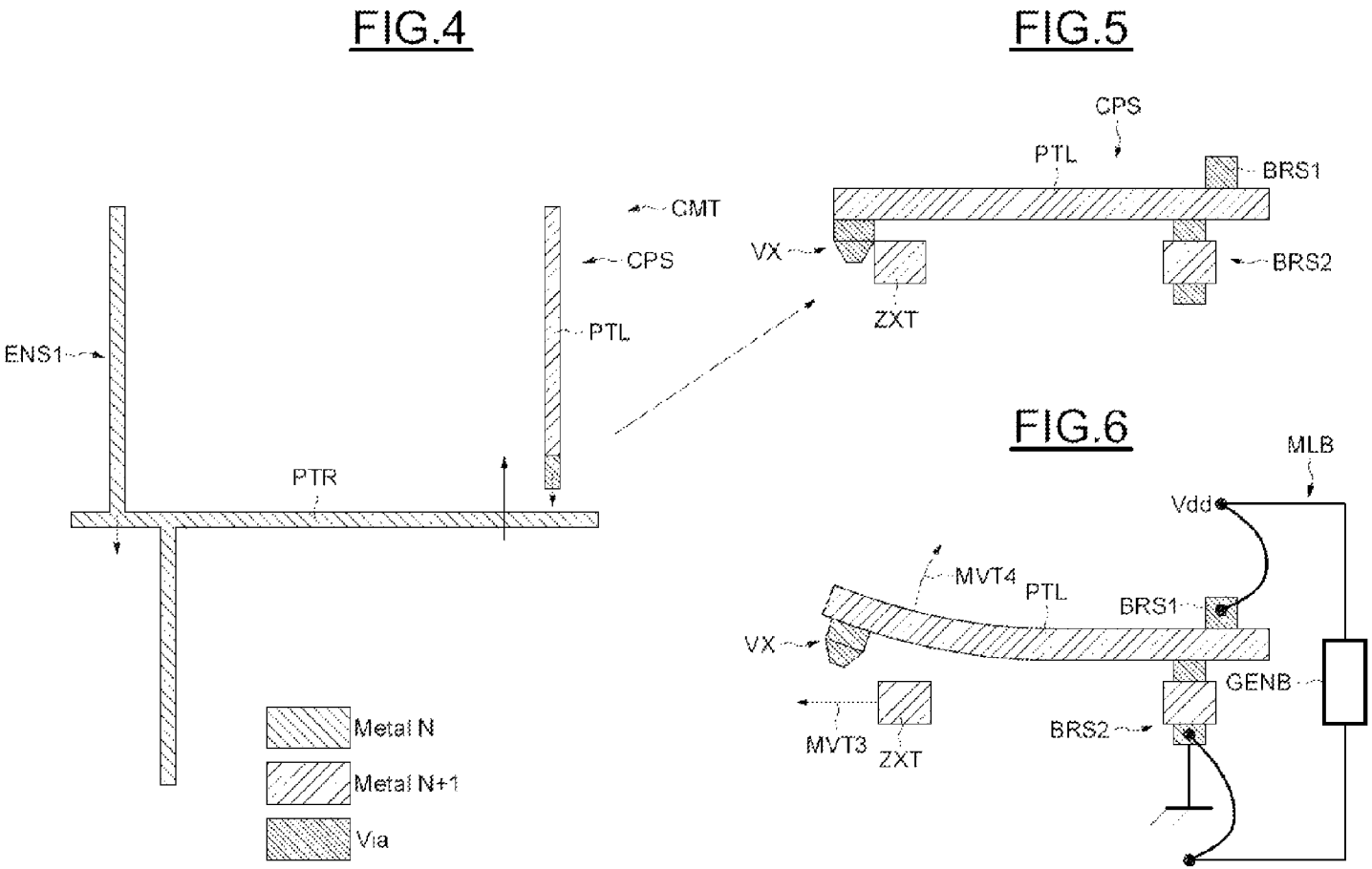

In the example illustrated in FIGS. 4 to 6, the means MLB comprise here, as illustrated in FIG. 5, a first arm BRS1 formed by a via, and a second arm BRS2 formed here by a metallic portion situated at the metal level N and by two vias placed on either side of this metallic portion.

The arms BRS1 and BRS2 are secured to the beam PTL in the vicinity of the end opposite to that to which the appendage VX is connected. They are spaced relative to one another so as to form with the beam PTL a thermally deformable assembly.

In addition to these arms BRS1 and BRS2, the means MLB also comprise, as illustrated in FIG. 6, means GENB with a structure for example similar to the means GEN of FIG. 2 and capable of generating a potential difference between the two arms BRS1 and BRS2 so as to deform, by Joule effect, the beam PTL. Via this deformation movement MVT4, the beam PTL will therefore bend upwards.

Thus, FIG. 4 illustrates the assembly ENS1 in its first configuration in which the beam PTR is at a distance from the body CPS.

FIG. 5 illustrates the assembly ENS1 in its second configuration in which the end ZXT of the beam PTR is hooked and immobilized by the appendage VX of the body CPS.

And FIG. 6 illustrates the release of the beam PTR by the bending of the beam PTL in the movement MVT4. Because of this, the beam PTR, released from the stresses of immobilization by the appendage VX, returns to its initial configuration (movement MVT3).

The switch CMT is then to some extent reset and can again be used to detect the exceeding of a temperature threshold or an over-current.

Figure 8:
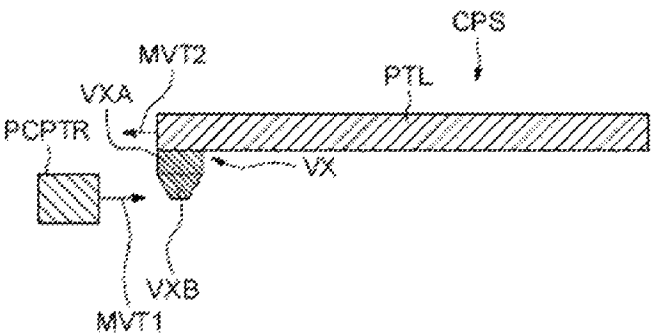
Figure 7:
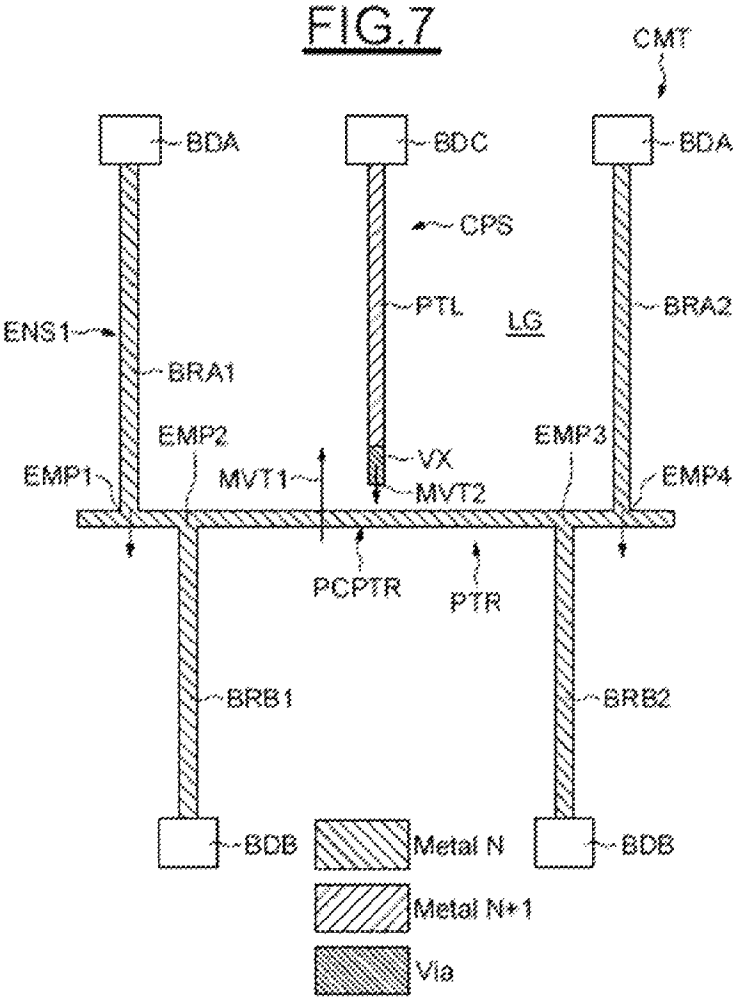

FIGS. 7 and 8 illustrate another embodiment of the switch CMT.

More particularly, in FIG. 7, the assembly ENS1 comprises a first pair of first arms BRA1, BRA2 respectively fixed to a first face of the beam PTR at the locations EMP1 and EMP4 situated in the vicinity of the two ends of the beam PTR.

The assembly ENS1 also comprises a second pair of second arms BRB1, BRB2 respectively fixed to a second face of the beam PTR, opposite to the first face, at two locations EMP2, EMP3 respectively situated in the vicinity of the two ends of the portion PCPTR of the beam situated between the arms of the first pair BRA1, BRA2.

This portion PCPTR of the beam, which includes the central portion of the beam, is situated, as illustrated in FIG. 7, when the assembly ENS1 is in its first configuration, at a distance from the body CPS.

Naturally, here again, the locations EMP1 and EMP2 are spaced in the longitudinal direction of the beam like the locations EMP3 and EMP4.

The body CPS is for its part identical to that which has been described with reference to FIGS. 2 and 3, the via VX comprising, as indicated above, an end portion VXB that widens out in the direction of the beam PTL so as to allow the central portion PCPTR of the beam of the other side of the via VX to pass when there is a temperature rise of the assembly ENS1, as illustrated more particularly in FIGS. 9 and 10.

Figure 10:
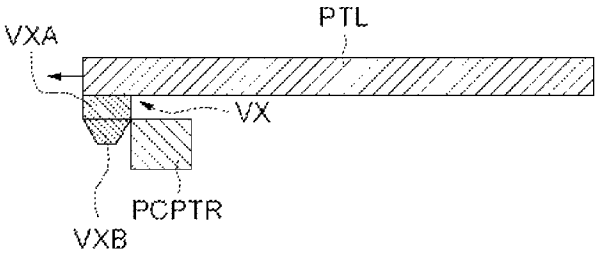
Figure 9:
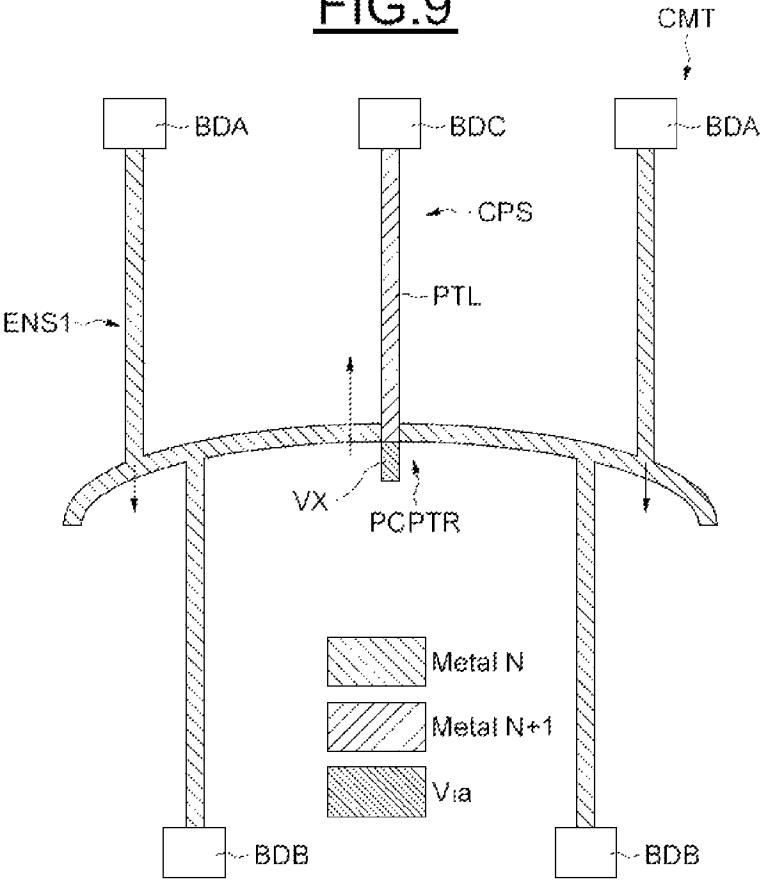

These FIGS. 9 and 10 illustrate the assembly ENS1 in its second configuration in which the central portion PCPTR of the beam PTR is this time hooked and immobilized by the via VX.

Naturally, it would also be possible in this variant to choose an arm CPS similar to that which has been described with reference to FIGS. 5 and 6 associated with releasing means MLB allowing the beam PCPTR to return to an initial configuration.

Figure 12:
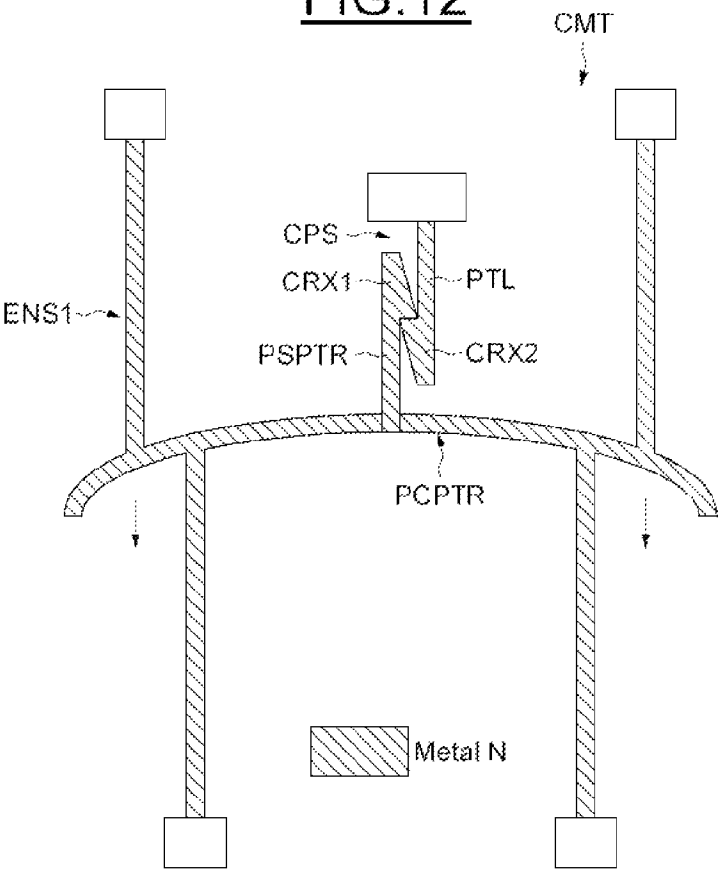
Figure 11:
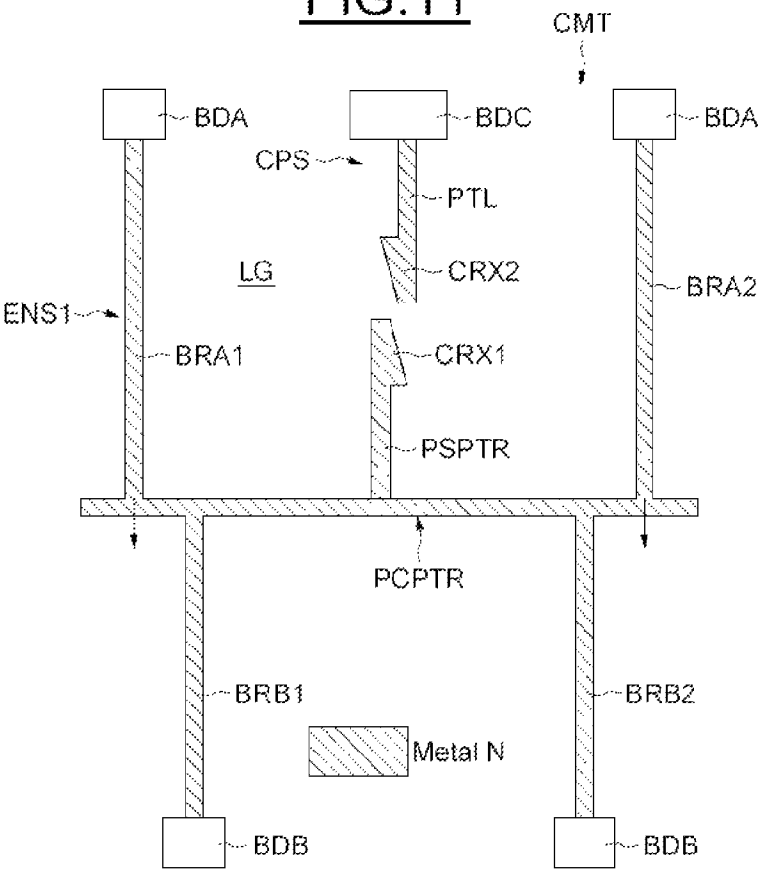

Whereas in the embodiments illustrated in the preceding figures the assembly ENS1 and the body CPS were produced within different metallization levels, they are, in the embodiment illustrated in FIGS. 11 and 12, produced within one and the same metallization level, for example the metal level N.

More precisely, in such an embodiment within one and the same metallization level, the first assembly comprises a portion forming a hook and the body comprises a portion forming a hook, the two portions forming hooks being at a distance from each other in one of the configurations and fitted into each other in the other configuration.

In the example illustrated in FIG. 11, which shows the assembly ENS1 in its first configuration, in which the hook secured to this assembly is at a distance from the hook secured to the body CPS, the assembly ENS1 essentially has a structure similar to that which has been described with reference to FIG. 7 and also comprises, attached in the vicinity of the central portion PCPTR of the beam PTR, an additional arm BSPTR furnished at its end with a hook CRX1.

The body CPS has, in this embodiment, in addition to the beam PTL mounted as a cantilever and secured to the edge BDC of the housing LG, a hook CRX2 placed at the free end of the beam PTL.

In the configuration of FIG. 11, the two hooks CRX1 and CRX2 are at a distance from one another.

On the other hand, when there is a temperature rise, whether it be a natural rise or by Joule effect, the central portion of the beam PCPTR bends in a manner similar to that which has been described with reference to FIG. 7, and the two hooks CRX1 and CRX2 fit into one another.

The assembly is then in its second configuration in which the beam PTR is immobilized by the hook CRX2.

This configuration is also naturally irreversible.

This being so, it would also be possible to fit the body CPS with additional arms like those that have been described with reference to FIG. 5 and to provide generation means GENB capable of applying a potential difference to these additional arms so as to cause the beam PTL to bend and thus disengage the hook CRX2 from the hook CRX1, the central portion PCPTR of the beam then returning to an initial configuration.

Figure 13:
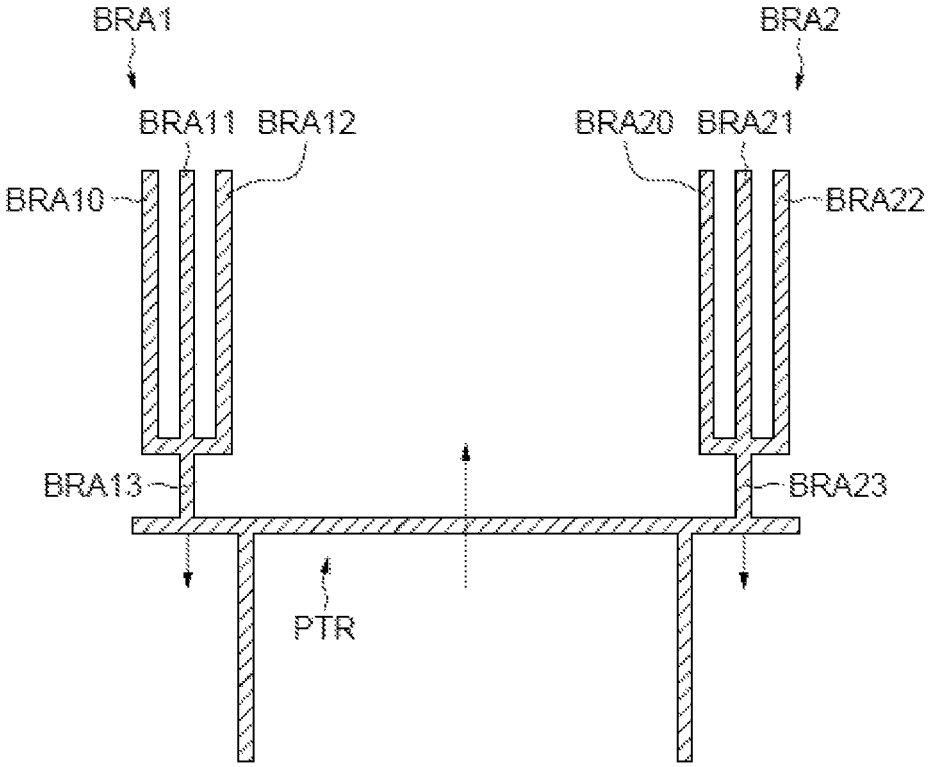

In the embodiments illustrated in FIGS. 7 to 12, each arm BRA1, BRA2 may comprise, as illustrated in FIG. 13, several parallel branches, here three parallel branches BRA10-BRAl2 and BRA20-BRA22 respectively connected to the beam PTR by two end portions BRA13 and BRA23 secured to the beam PTR.

Such an embodiment makes it possible to have greater thermal deformations.

In the embodiments that have just been described, the assembly ENS1 moved from a first configuration in which the beam PTR of this assembly ENS1 was at a distance from the body CPS, prohibiting the establishment of an electrical link passing through the beam and the body CPS, to a second configuration in which the body CPS immobilized the beam PTR in order to allow the establishment of an electrical link passing through the beam and the body.

In other embodiments, it will be seen that the assembly ENS1 will move from a first configuration in which it is immobilized by the body to a second configuration in which the beam PTR of this assembly ENS1 is at a distance from the body prohibiting the establishment of an electrical link between these two elements, the movement from the first configuration to the second configuration this time being totally irreversible.

This is obtained by providing a body comprising a first portion situated within a second metallization level different from the first metallization level within which the assembly ENS1 is produced, a second breakable portion connected to the first portion and extending between the two metallization levels.

The beam of the first assembly is then secured to the first portion of the body by means of the breakable portion in the first configuration and separated from the first portion of the body and not in contact with this first portion of the body in the other configuration, the breakable portion, in this other configuration, then being broken.

Figure 15:
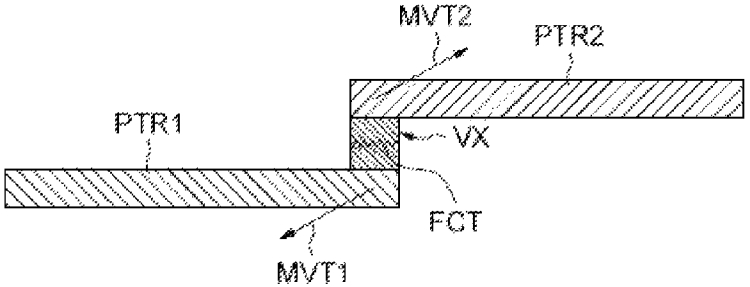
Figure 14:
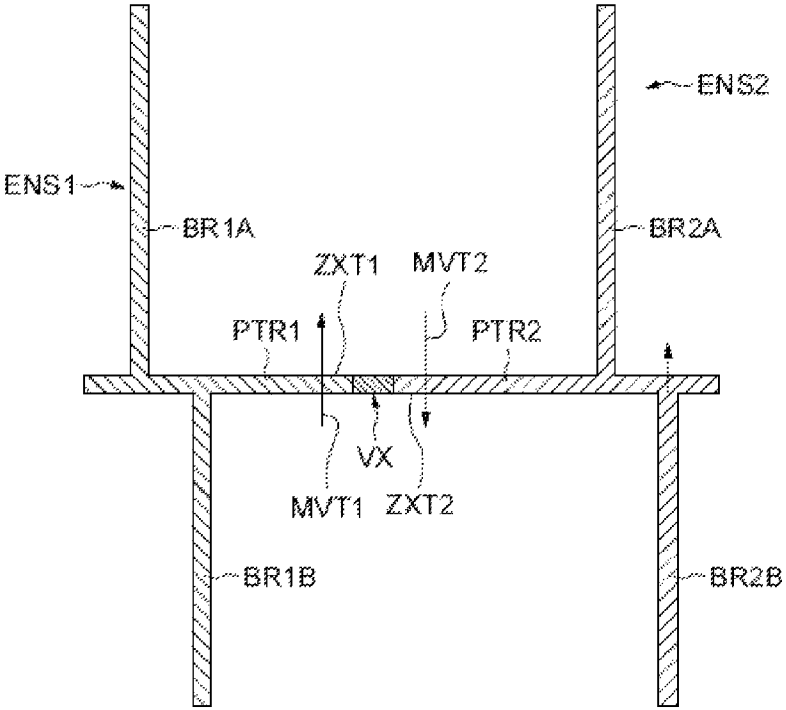

A more precise exemplary embodiment of such a "breakable" variant is illustrated in FIGS. 14 and 15.

The assembly ENS1 is produced within a first metallization level, namely the metallization level N and has a structure similar to that which has been described with reference to FIG. 2.

The body here comprises a second assembly ENS2 that is thermally deformable, with a structure similar to that of the first assembly ENS1 and situated on a second metallization level, namely the metallization level N+1.

The assembly ENS2 is mounted symmetrically relative to the first assembly.

Moreover, the body comprises, in addition to this second assembly ENS2, an electrically conductive appendage, in this instance a via VX forming the breakable portion.

As illustrated in FIG. 15, the via VX secures the two ends ZXT1 and ZXT2 of the beams PTR1 and PTR2 of the assemblies ENS1 and ENS2.

Since the two assemblies ENS1 and ENS2 are mounted symmetrically relative to one another, the ends ZXT1 and ZXT2 of the respective beams sustain, during a temperature change, for example a temperature rise, movements MVT1 and MVT2 in opposite directions causing a shearing of the via VX, the latter then breaking along a break line FCT (FIG. 15) which may be situated anywhere in the via, and for example at the interface between the via and one of the beams PTR1 or PTR2.

Figure 16:
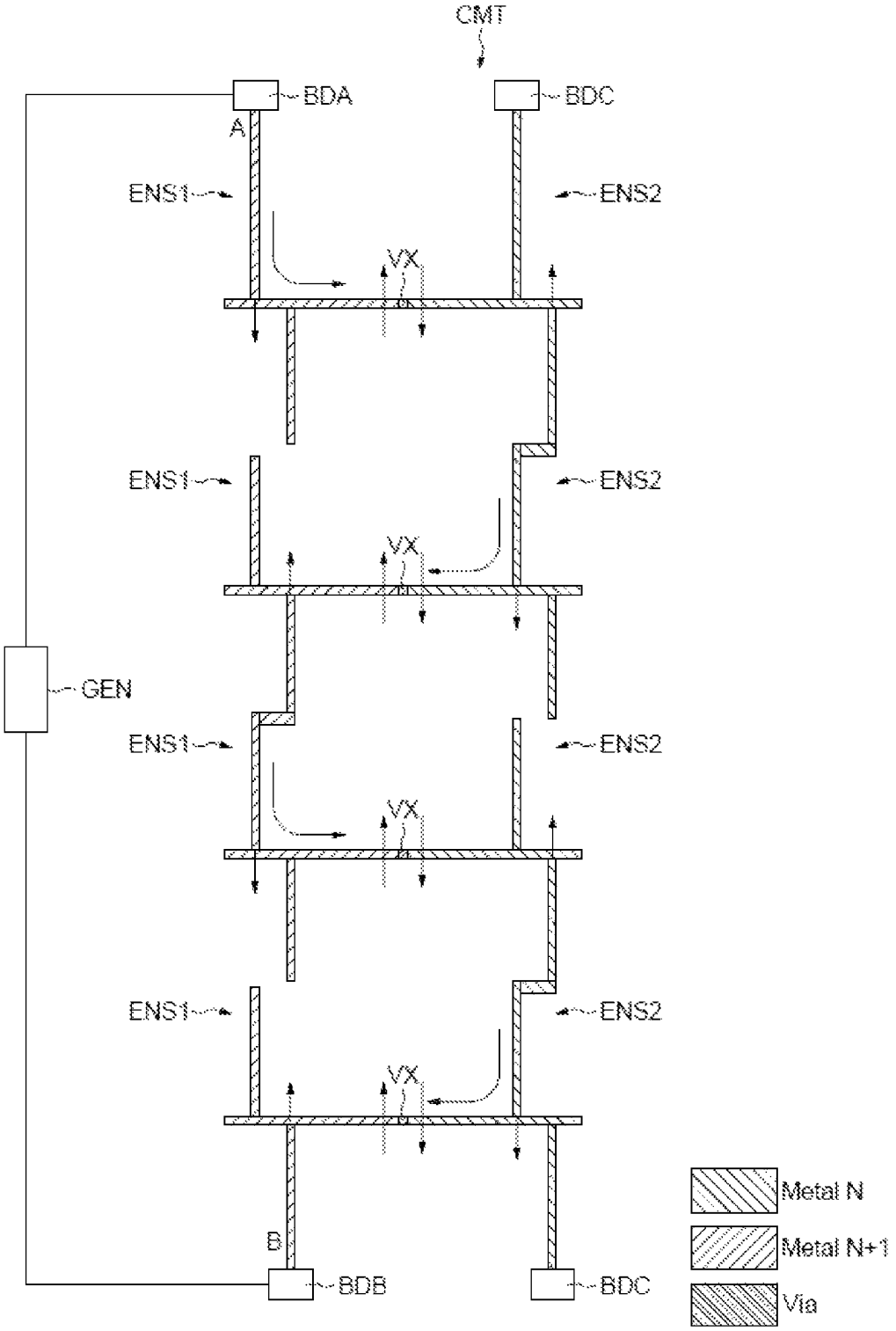

In the embodiment illustrated schematically in FIG. 16, the electrical-switching mechanical device CMT comprises several first assemblies ENS1 and several second assemblies ENS2 forming, in the configuration illustrated in FIG. 16, an electrically conductive chain in which all the breakable appendages VX, secured to the corresponding ends of the beams of the second assemblies ENS2 are also secured to the corresponding ends of the beams of the first assemblies ENS1.

The variant embodiment of FIG. 16 is illustrated with generation means GEN connected between the edges BDA and BDB of the housing and configured to apply a potential difference between these two edges so as to cause a current to flow in the electrically conductive chain and cause the shearing of at least one of the vias VX when the intensity of the current exceeds a predefined threshold.

Here again, these means GEN may be a portion of the integrated circuit delivering a current of which it is desired to detect a variation of intensity.

The embodiment of FIG. 16, by the use of a chain comprising several vias VX, makes it possible to increase the accuracy of the triggering of the threshold. Specifically, an industrial product has a natural technological variability. In other words, the mechanical characteristics of a via may vary slightly from one product to another and/or from one via to another because of the technological process dispersions. The presence of a chain of vias makes it possible to ensure a rough sampling of the population and to obtain a result that is more reproducible and closer to the desired result. Specifically, if one via is faulty, another via may break.

Naturally, other geometric configurations than that illustrated in FIG. 16 are possible. In this respect it could be envisaged to place such a chain in a circle around the integrated circuit.

Figure 17:
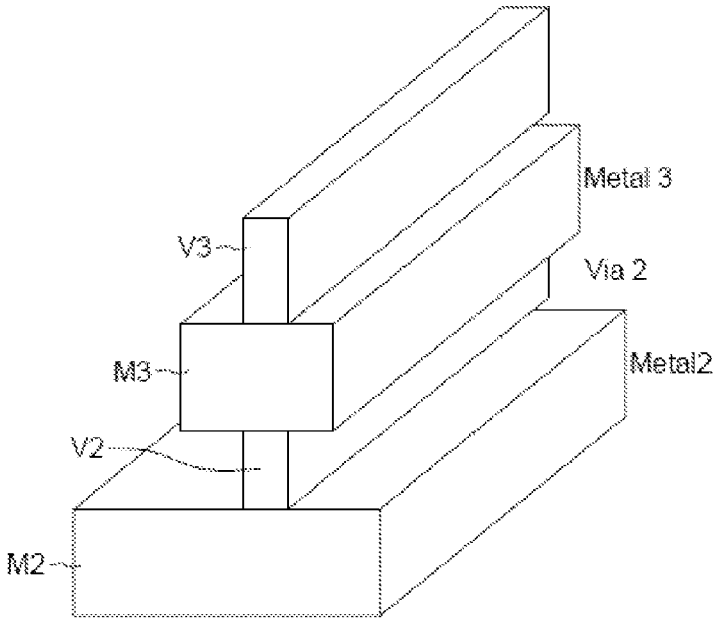
Figure 18:
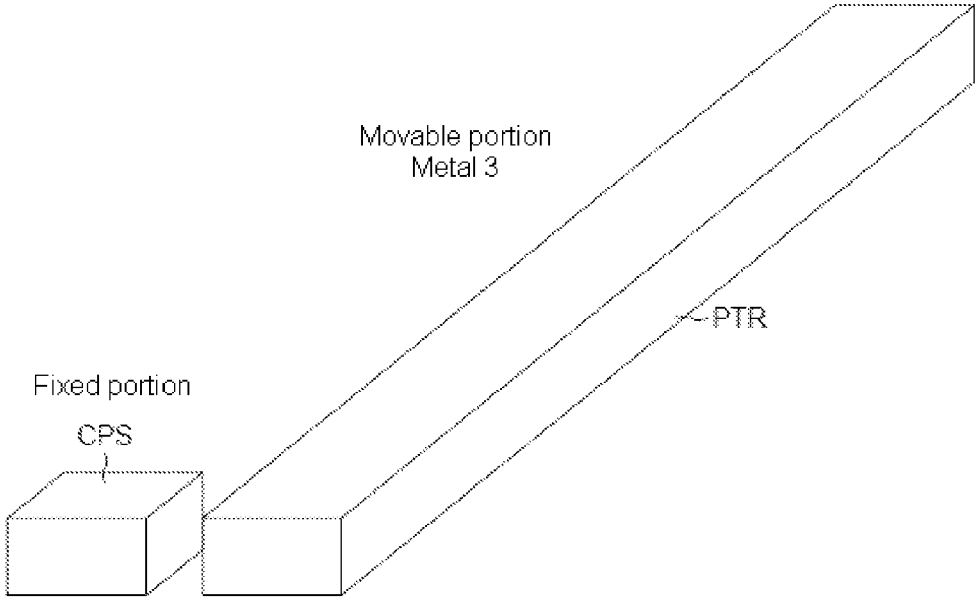
Figure 19:
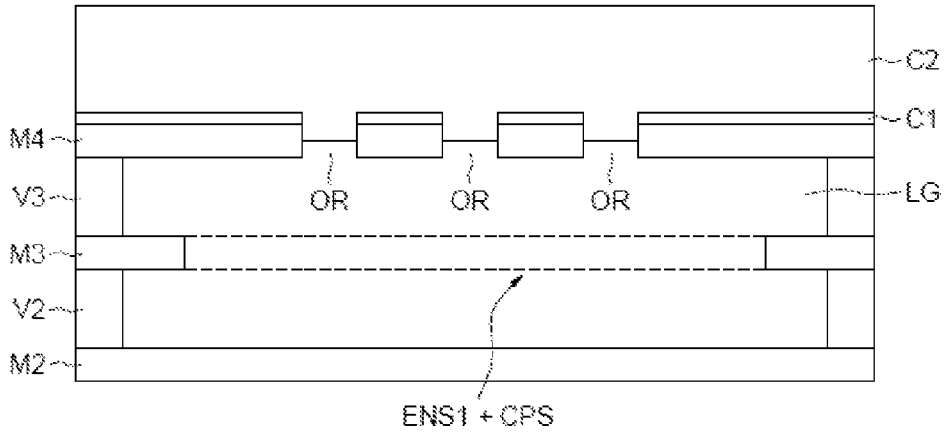

Reference is now made more particularly to FIGS. 17 to 19 in order to illustrate a fabrication method of an embodiment of a switch CMT according to the invention.

It is assumed in these figures that the assembly ENS1 and the body CPS are produced within one and the same metallization level, for example on metallization level M3 (metal 3).

It is then seen (FIG. 17) that the level V2 of via 2 between the metal level 2 and the metal level 3 and the level V3 of via 3 between the metal 3 and the metal 4 are used to form a "protective" wall for the oxide etching that will follow and allow the deencapsulation of the assembly ENS1 and of the body CPS.

Moreover, as illustrated in FIG. 18, both the movable portion of the switch CMT, in this instance the beam PTR, and the fixed portion, in this instance the body CPS and more particularly the hook CRX2 in the case of the variant illustrated in FIG. 11, are produced on the metal level 3.

The switch CMT and notably the assembly ENS1 and the body CPS are produced by carrying out conventional fabrication steps for metallization levels and vias. More precisely, as illustrated in FIG. 19, after production of the first metal level M2 and of the via level V2, the assembly ENS1 and the body CPS, shown here in dashed lines for simplification purposes, are produced in a conventional manner by underlying oxide etching and deposition of metal, in this instance of copper, in the grooves. Then, the assembly is covered with oxide and the metallization level M4 is then produced.

After formation on the metal level 4 of a conventional nitride layer C1, a comb is produced in this metal level 4 in order to form orifices OR.

Then an isotropic dry etching is carried out followed by a wet etching for example with hydrofluoric acid, so as to eliminate the insulating (oxide) region encapsulating the assembly ENS1 and the body CPS and to thereby produce the housing LG.

Then, a nonconforming oxide deposition is carried out so as to form a layer C2 blocking the orifices OR.

Naturally, what has just been described for the metal levels M2, M3, M4 may be expanded to include the metal level Mi−1, Mi, Mi+1.

The conventional process for producing the various upper metallization levels then continues.

If the assembly ENS1 and the body CPS are produced on different metallization levels, the same method is applied while simply increasing the number of via levels and the number of metallization levels.

What is claimed is:

1. An integrated circuit, comprising:

a first metallization level separated from a second metallization level by an insulating region and disposed on a substrate; and an electrical-switching mechanical device in a housing, the electrical-switching mechanical device comprising:

a first thermally deformable assembly including a beam held in at least two different locations by at least two arms secured to edges of the housing, the beam and the arms being metallic and situated within the first metallization level; and an electrically conductive body;

wherein the first thermally deformable assembly has a first configuration at a first temperature and a second configuration at a second temperature different from the first temperature;

wherein the beam is at a distance from the body in the first configuration and in contact with the body and immobilized by the body in the second configuration and establishing or prohibiting an electrical link passing through the body and through the beam; and wherein the first thermally deformable assembly is configured to be activated and switch from one of the configurations to another.

2. The integrated circuit according to claim 1, wherein the body comprises a first portion situated within the second metallization level and a second portion connected to the first portion and extending between the first and second metallization levels and partly within the first metallization level, the beam being at a distance from the second portion of the body in one of the first and second configurations and hooked by and in contact with the second portion of the body in the other of the first and second configurations.

3. The integrated circuit according to claim 2, wherein the body comprises a metallic cantilevered beam extending substantially perpendicularly to the beam of the first thermally deformable assembly and forming the first portion, and an electrically conductive appendage situated at a free end of the cantilevered beam and forming the second portion, an end portion of the appendage extending in the first metallization level and widening out toward the cantilevered beam.

4. The integrated circuit according to claim 3, wherein the first thermally deformable assembly comprises the beam and two arms each respectively secured at a separate fixing point to the beam on two opposite faces of the beam, the two arms being spaced apart by a distance in a longitudinal direction of the beam, the second portion of the body situated between a free end of the beam and one of the fixing points.

5. The integrated circuit according to claim 3, wherein the thermally deformable first assembly comprises a first pair of first arms respectively fixed to a first face of the beam in a vicinity of respective ends of the beam and spaced in a longitudinal direction of the beam, a second pair of second arms both fixed to a second face of the beam and spaced in a longitudinal direction of the beam, opposite to the first face, in a vicinity of respective ends of the portion of the beam situated between the arms of the first pair, and a hooked beam member disposed on a central portion of the beam.

6. The integrated circuit according to claim 5, wherein each first arm comprises several branches connected to an end portion secured to the beam.

7. The integrated circuit according to claim 1, wherein the beam of the first thermally deformable assembly comprises a portion forming a first hook and the body comprises a portion forming a second hook situated within the first metallization level, the first and second hook being at a distance from each other in one of the first and second configurations and fitted into each other in the other of the first and second configurations.

8. The integrated circuit according to claim 1, wherein the electrical-switching mechanical device further comprises means configured to selectively release the beam when immobilized by the body.

9. The integrated circuit according to claim 1, wherein the body comprises a first portion situated within the second metallization level different from the first metallization level, and a breakable portion connected to the first portion and extending between the first and second metallization levels, the beam of the first thermally deformable assembly being secured to the first portion of the body by means of the breakable portion in one of the first and second configurations and separated from and not in contact with the first portion of the body in the other of the first and second configurations, the breakable portion being broken in this other configuration.

10. The integrated circuit according to claim 9, wherein the first thermally deformable assembly comprises the beam and two arms each respectively secured to the beam at each one of two fixing points on opposite faces of the beam, the two fixing points of the two arms spaced apart by a distance in a longitudinal direction of the beam, the beam of the first thermally deformable assembly being secured to the first portion of the body by the breakable portion in a vicinity of a free end.

11. The integrated circuit according to claim 10, in which the body comprises a second thermally deformable assembly forming the first portion, situated on a second metallization level, mounted symmetrically relative to the first thermally deformable assembly, and an electrically conductive appendage, forming the breakable portion, situated in a vicinity of a free end of the beam of the second thermally deformable assembly.

12. The integrated circuit according to claim 11, in which the electrical-switching mechanical device comprises a plurality of first thermally deformable assemblies and a plurality of second thermally deformable assemblies forming, in a first configuration, an electrically conductive chain in which all the breakable appendages are respectively secured to corresponding ends of the beams of the first assemblies.

13. The integrated circuit according to claim 1, further comprising a current source configured to apply an electrical current to flow in at least one of the arms and raise a temperature of the at least one of the arms.

14. The integrated circuit according to claim 1, further comprising a controller connected to the electrical-switching mechanical device and configured to test the establishment or non-establishment of the electrical link.

15. An integrated circuit, comprising:

a first metallization level separated from a second metallization level by an insulating region and disposed on a substrate; and a first electrical-switching mechanical device in a housing comprising:

at least one first thermally deformable assembly comprising at least two arms secured to edges of the housing and a beam held in at least two different locations by the at least two arms; and a body formed from a conductive material;

wherein the first thermally deformable assembly has a first configuration at a first temperature and a second configuration at a second temperature different from the first temperature, and wherein the beam is at a distance from the body in the first configuration and in contact with the body and immobilized by the body in the second configuration, and configured to establish an electrical link passing through the body and through the beam in one of the first configuration and the second configuration and configured to prohibit an electrical link passing through the body and through the beam in the other of the first configuration and the second configuration.

16. The integrated circuit of claim 15, the electrical-switching mechanical device further comprising a conductive appendage disposed between and in contact with the beam and the body and forming an electrical link with the beam and the body in the one of the first configuration and the second configuration, and configured to break and prohibit an electrical link between the beam and the body in the other of the first configuration and the second configuration.

17. The integrated circuit of claim 16, further comprising a plurality of second electrical-switching mechanical devices connected in series and connected in series with the first electrical-switching mechanical device, the first electrical-switching mechanical device and the plurality of second electrical-switching mechanical devices configured to provide an electrical link through the first electrical-switching mechanical device and the plurality of second electrical-switching mechanical devices then each beam of each of the first electrical-switching mechanical device and the plurality of second electrical-switching mechanical devices is in a same one of the first configuration and the second configuration and configured to prohibit an electrical link when a beam of one of the first electrical-switching mechanical device and the plurality of second electrical-switching mechanical devices is in the other of the first configuration and the second configuration.

18. An integrated circuit, comprising:

a first metallization level separated from a second metallization level by an insulating region and disposed on a substrate;

an electrical-switching mechanical device in a housing, the electrical-switching mechanical device comprising:

a first thermally deformable assembly including a beam secured to edges of the housing by a plurality of arms, the beam and the arms being metallic and located within the first metallization level; and an electrically conductive body comprising a first portion located within the second metallization level and a second portion connected to the first portion and extending between the first and second metallization levels and partly within the first metallization level; and a current source coupled to one of the arms;

wherein the first thermally deformable assembly has a first configuration at a first temperature and a second configuration at a second temperature different from the first temperature;

wherein the beam is at a distance from the second portion of the body in the first configuration and hooked by and in contact with the second portion of the body in the second configuration, thereby establishing or prohibiting an electrical link passing through the body and through the beam; and wherein the first thermally deformable assembly is configured to be activated and switch from one of the configurations to another.

19. The integrated circuit according to claim 18, wherein the body comprises a metallic cantilevered beam extending substantially perpendicularly to the beam of the first thermally deformable assembly and forming the first portion, and an electrically conductive appendage situated at a free end of the cantilevered beam and forming the second portion, an end portion of the appendage extending in the first metallization level and widening out toward the cantilevered beam.

20. The integrated circuit according to claim 19, wherein the first thermally deformable assembly comprises the beam and two arms that are each respectively secured at a separate fixing point to the beam on two opposite faces of the beam, the two arms being spaced apart by a distance in a longitudinal direction of the beam, the second portion of the body situated between a free end of the beam and one of the fixing points.

21. The integrated circuit according to claim 19, wherein the thermally deformable first assembly comprises a first pair of first arms respectively fixed to a first face of the beam in a vicinity of respective ends of the beam and spaced in a longitudinal direction of the beam, a second pair of second arms both fixed to a second face of the beam and spaced in a longitudinal direction of the beam, opposite to the first face, in a vicinity of respective ends of the portion of the beam situated between the arms of the first pair, and a hooked beam member disposed on a central portion of the beam.

22. The integrated circuit according to claim 21, wherein each first arm comprises a plurality branches connected to an end portion secured to the beam.

* * * * *